US008834235B1

(12) United States Patent
Foster

(10) Patent No.: US 8,834,235 B1
(45) Date of Patent: Sep. 16, 2014

(54) FLEXIBLE SANDER

(71) Applicant: Thomas E. Foster, Austin, TX (US)

(72) Inventor: Thomas E. Foster, Austin, TX (US)

( * ) Notice: Subject to any disclaimer, the term of this patent is extended or adjusted under 35 U.S.C. 154(b) by 0 days.

(21) Appl. No.: 14/039,763

(22) Filed: Sep. 27, 2013

(51) Int. Cl.
*B24D 9/00* (2006.01)
*B24D 15/04* (2006.01)

(52) U.S. Cl.
CPC ..... *B24D 15/04* (2013.01)
USPC ..... 451/524; 451/492; 451/495; 451/490; 451/354; 451/344

(58) Field of Classification Search
CPC ..... B24D 9/003; B24D 9/006; B24D 9/02; B24B 23/00
USPC ..... 451/490–519, 523–525, 354, 344
See application file for complete search history.

(56) References Cited

U.S. PATENT DOCUMENTS

| | | | | | |
|---|---|---|---|---|---|
| 955,575 | A * | 4/1910 | Bell | 451/519 |
| 1,668,966 | A * | 5/1928 | Kirwin et al. | 451/351 |
| 1,827,300 | A * | 10/1931 | Pritchard et al. | 101/415.1 |
| 2,307,431 | A * | 1/1943 | Tilden et al. | 451/356 |
| 2,547,837 | A * | 4/1951 | Robbins | 451/519 |
| 2,761,257 | A * | 9/1956 | Mendelsohn | 451/504 |
| 2,809,476 | A * | 10/1957 | Bourdunis | 451/491 |
| 3,106,806 | A * | 10/1963 | Hutchins | 451/504 |
| 3,123,947 | A * | 3/1964 | Rawley | 451/495 |
| 3,229,428 | A * | 1/1966 | Sargolini et al. | 451/415 |
| 4,730,430 | A * | 3/1988 | Petrovich | 451/519 |
| 4,918,875 | A | 4/1990 | Klocke | |
| 5,022,189 | A * | 6/1991 | Saul | 451/356 |
| 5,662,519 | A | 9/1997 | Arnold | |
| 6,120,365 | A | 9/2000 | Johnson | |
| 6,544,113 | B1 | 4/2003 | Wheeler | |
| 6,733,376 | B2 * | 5/2004 | Williams | 451/344 |
| 7,467,991 | B2 * | 12/2008 | McCowen et al. | 451/349 |
| 8,007,349 | B2 | 8/2011 | Turnbull | |
| 8,057,286 | B2 | 11/2011 | Walsh | |
| 8,210,910 | B2 * | 7/2012 | McLain | 451/524 |
| 2002/0086627 | A1 | 7/2002 | Andrews et al. | |
| 2002/0164937 | A1 * | 11/2002 | Williams | 451/344 |
| 2003/0003854 | A1 * | 1/2003 | Deware et al. | 451/59 |
| 2003/0104777 | A1 * | 6/2003 | Deshler | 451/514 |
| 2011/0092143 | A1 * | 4/2011 | Unruh et al. | 451/513 |
| 2011/0271476 | A1 | 11/2011 | Robideau | |
| 2013/0109284 | A1 | 5/2013 | Andonian | |

FOREIGN PATENT DOCUMENTS

| | | |
|---|---|---|
| WO | 0006342 | 2/2000 |

* cited by examiner

*Primary Examiner* — George Nguyen
(74) *Attorney, Agent, or Firm* — Meyertons, Hood, Kivlin, Kowert & Goetzel, P.C.; Eric B. Meyertons

(57) ABSTRACT

A flexible sanding apparatus includes a thin, relatively flat spring member and one or more coil spring members coupled to a first side of the flat spring member along a length of the flat spring member. A sanding surface may be coupled to a second side of the flat spring member. The flat spring member and the coil spring members may be elongated members coupled together lengthwise. The coil spring member may be a closed coil spring member that allows concave flexing of the sanding surface and inhibits convex flexing of the sanding surface.

25 Claims, 4 Drawing Sheets

FLEXIBLE SANDER

BACKGROUND

1. Field of the Invention

The present invention relates to a contour sander. More particularly, the invention relates to a flexible sander and/or spreader for use on single or compound curved surfaces and also can be used to flatten surfaces.

2. Description of Related Art

One of the more common uses of contour sanders is repairing automobile body panels. Automobile body panels are typically made of light-weight metals, fiberglass, or plastic materials that are relatively thin. The panels are shaped into contoured (curved) body lines to provide strength and aerodynamic features for the body panels. The contoured body lines may include convex or concave curves, scooped areas, and/or channels. The sanders used on the body panels may have an adjustable curvature to allow the sander to conform to different shaped body panels and allow the sander to be used on multiple body panels and/or automobiles. The curvature of the sander may be adjusted to conform to the curvature of a specific body panel to provide accurate sanding on the body panel surface (e.g., sanding of the body panel to return the body panel as close to its original shape as possible).

U.S. Pat. No. 6,554,113 to Wheeler, which is incorporated by reference as if fully set forth herein, discloses a flexible sanding apparatus with adjustable curvature. This flexible sanding apparatus uses a flexible foam rubber handle with a thick profile. The flexibility of the foam rubber handle is controlled by the insertion/removal of three rods inside the handle. Flexing the foam rubber handle may, however, create build up in the handle because the top stretches as the handle is bent and the bottom portion does not compress since it is attached to a flat spring. The flat spring in the foam rubber handle is only bent by pressing down on the ends of the foam rubber handle. However, it may take significant pressure to bend the ends of the foam rubber handle down to curve the handle and the handle may have a limited amount of bend that prevents the handle from having the ability to work on smaller radius curves.

Because high pressure is needed to bend the flexible sanding apparatus described in U.S. Pat. No. 6,554,113 to Wheeler, the curve of the flexible sanding apparatus is determined by the profile of the surface being sanded instead of the curve being determined by the desire of the user (e.g., how much the user wants the sander to curve). In addition, when high pressure is applied, the flexible sanding apparatus may not provide the desired arc because of the thickness and stiffness of the flexible sanding apparatus. In some situations, the flexible sanding apparatus may require substantially equal high pressure to be applied substantially simultaneously to both the ends of the foam rubber handle to make it meet the contours of the surface. Providing high pressure substantially simultaneously to the ends may, however, be tiring to a user and not allow the user to have any "feel" for the contour of the body panel being worked on by the user.

Another problem with the flexible sanding apparatus described in U.S. Pat. No. 6,554,113 to Wheeler is that the foam rubber handle may bend backward (e.g., bend with the ends going away from the surface) when pressure is applied to the foam rubber handle. Thus, when sanding a relatively flat surface, the low spots on the flexible sanding apparatus may be lower than desired, making it difficult to obtain a flat sanding surface.

Thus, there is a need for a sander/spreader that has variable flexibility that is determined by the user without needing high pressure to curve the sander/spreader. The sander/spreader may be easily flexed by the user to conform to various curved surfaces with different curvatures while also allowing the sander/spreader to maintain a relatively flat profile when needed (e.g., when used on a flat surface). The sander/spreader may also allow for sanding of convex and/or concave profiles without bunching or crumpling of the sanding surface (e.g., sandpaper attached to the sander/spreader).

SUMMARY

In certain embodiments, a flexible sanding apparatus includes a thin, relatively flat spring member and one or more coil spring members coupled to a first side of the flat spring member along a length of the flat spring member. A sanding surface may be coupled to a second side of the flat spring member. The flat spring member and the coil spring members may be elongated members coupled together lengthwise. In certain embodiments, at least one coil spring member is a closed coil spring member. The closed coil spring member may allow concave flexing of the sanding surface and inhibit convex flexing of the sanding surface. In some embodiments, the sanding apparatus includes a cover that at least partially encloses the coil spring members.

In certain embodiments, a flexible sanding apparatus includes a first thin, relatively flat spring member and one or more coil spring members coupled to a first side of the flat spring member along a length of the flat spring member. A first cover portion may at least partially enclose the coil spring members on the first flat spring member. A first sanding surface may be coupled to a second side of the flat spring member. In some embodiments, the sanding apparatus includes a second thin, relatively flat spring member removably coupled to the first cover portion using a second cover portion. A second sanding surface may be coupled to a surface of the second flat spring member opposite the second side of the first flat spring member coupled to the first sanding surface. The first sanding surface may be used for sanding flat or convex surfaces, and the second sanding surface may be used for sanding concave surfaces.

BRIEF DESCRIPTION OF THE DRAWINGS

Features and advantages of the methods and apparatus of the present invention will be more fully appreciated by reference to the following detailed description of presently preferred but nonetheless illustrative embodiments in accordance with the present invention when taken in conjunction with the accompanying drawings in which.

Figure 1:
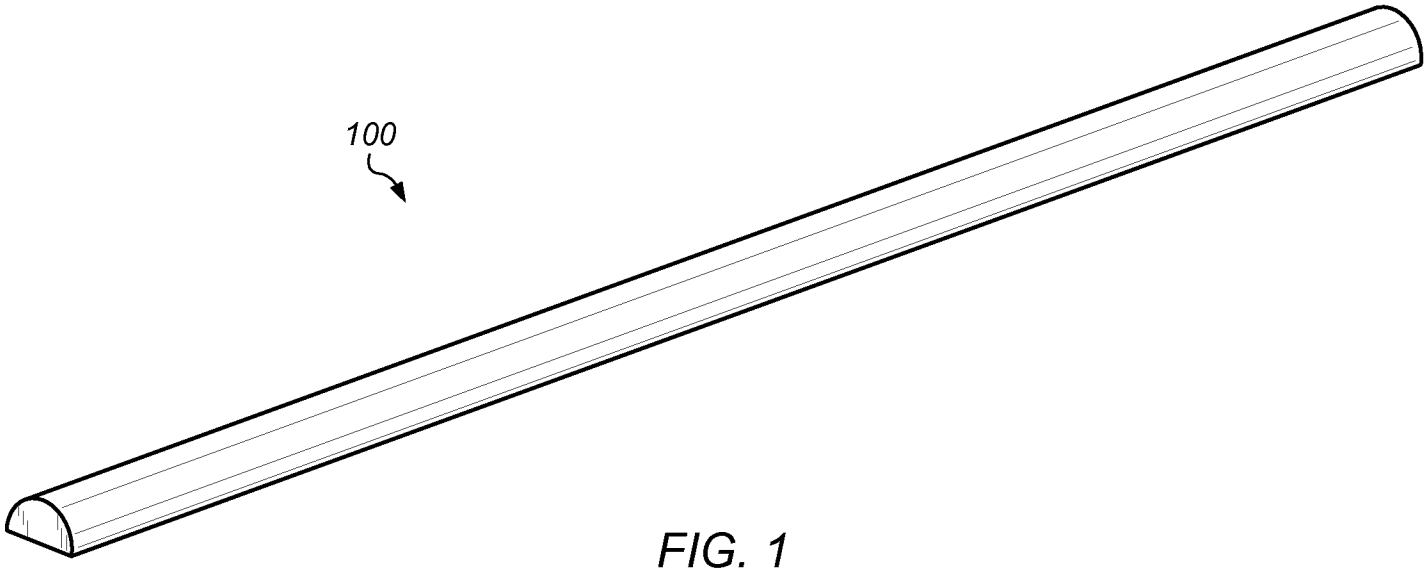
FIG. 1 depicts a perspective view of an embodiment of a sander.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION OF EMBODIMENTS

In the context of this patent, the term "coupled" means either a direct connection or an indirect connection (e.g., one or more intervening connections) between one or more objects or components. The phrase "directly connected" means a direct connection between objects or components such that the objects or components are connected directly to each other so that the objects or components operate in a "point of use" manner.

In the context of this patent, the term "automobile" refers to any type of motor vehicle such as a car, truck, or SUV. It is to be understood that while reference is made to the use of the sanding/spreading apparatus (e.g., "sander") on surfaces of an automobile that the sanding/spreading apparatus may be used in many other instances. For example, the sander may be used on single or compound curved surfaces and may also be used to flatten surfaces. The sander may be used on any surface that can be sanded to smooth out imperfections or to create smooth contours. Examples of surfaces included, but are not limited to, automobile bodies, boats, furniture, stone art work, metal, plaster, fiberglass, and wood. In some instances, the sander may be used in homes for trim, sheetrock, arches, columns, and/or general paint preparation.

Figure 2:
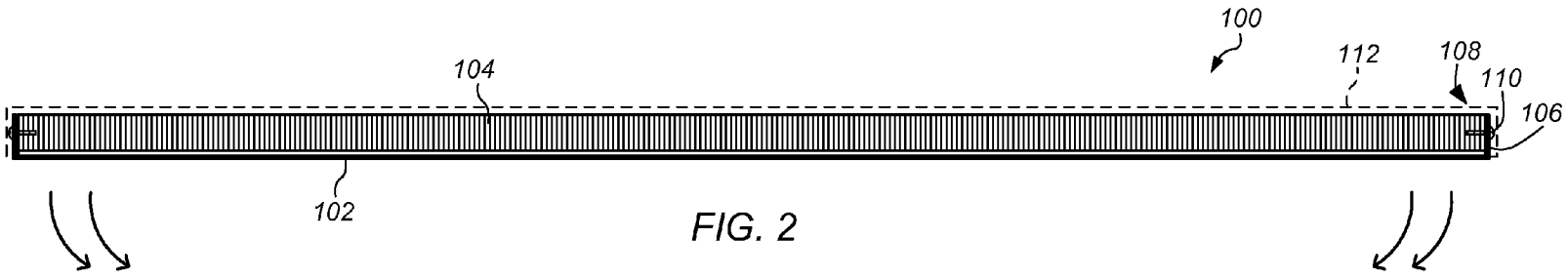
FIG. 2 depicts a cross-sectional side-view representation of an embodiment of a sander.

FIG. 1 depicts a perspective view of an embodiment of sander 100. Sander 100 may be use, for example, for sanding surfaces of an automobile and/or spreading materials (e.g., caulks, fillers, etc.) on surfaces of the automobile. FIG. 2 depicts a cross-sectional side-view representation of an embodiment of sander 100. In certain embodiments, sander 100 includes flat spring member 102 and coil spring member 104. Coil spring member 104 may be coupled to a top side of flat spring member 102.

Flat spring member 102 may be, for example, an elongated thin, relatively flat piece of strong, flexible material such as, but not limited to, steel (e.g., stainless steel), carbon fiber, or fiberglass. For example, flat spring member 102 may have a length greater than about 3", about 6", or about 12" while having a width in a range between about ½" and about 1.5". In certain embodiments, flat spring member 102 stretches on one side and compresses on the other side for the flat spring member to bend. A thicker flat spring member may have more resistance to bending and have more stretching and compression than a thinner flat spring member. Having a thinner flat spring member 102 allows sandpaper or another similar material that has limited stretchability and/or compressibility to adhere to the surface of the flat spring member without tearing or buckling.

In certain embodiments, coil spring member 104 is an elongated steel coil spring. Coil spring member 104 may also be made of other strong, flexible materials such as, but not limited to, carbon fiber or fiberglass. Coil spring member 104 may be flexible because, as the spring is bent, each coil is twisted a small amount. The small amount of twist in each coil allows coil spring member 104 to be bent with very little build up in resistance. The diameter of the spring wire used to make the coils may determine the resistance to bending of coil spring member 104 rather than the diameter of the coil. In certain embodiments, coil spring member 104 has a relatively large diameter (e.g., between about ¼" and about 1.5"). The relatively large coil diameter allows sander 100 to be very flexible and coil spring member 104 may have a size comfortable for a user to grip the sander using the coil spring member.

In certain embodiments, flat spring member 102 and coil spring member 104 are coupled together lengthwise (e.g., the spring members are elongated members coupled along their lengths). Flat spring member 102 and coil spring member 104 may be coupled, for example, using an adhesive material such as, but not limited to, an epoxy resin or glue. In some embodiments, flat spring member 102 and coil spring member 104 are fastened together using, for example, solder, braze, screws, or other fasteners known in the art.

In certain embodiments, flat spring member 102 and coil spring member 104 are able to be coupled and bent together because the coils at the coupling between the flat spring member and the coil spring member do not move in relation to the flat spring member. When flat spring member 102 and coil spring member 104 are bent to flex sander 100, a majority or all of the stretch or compression is on the outside of the coils away from the flat spring member. Thus, flat spring member 102 and coil spring member 104 may bend without interfering with each other.

As shown in FIG. 2, end portions 106 of flat spring member 102 may be turned up substantially perpendicular to the flat sides of the flat spring member. In certain embodiments, end portions 108 of coil spring member 104 are filled with a resin or other curable filling material to allow fasteners 110 to coupled end portions 106 of flat spring member 102 to the coil spring member. In some embodiments, end portions 108 of coil spring member 104 are filled with other solid materials (e.g., the coil spring member may have a solid metal material filling the end portions with a hole formed in the solid metal for fastener 110). Fasteners 110 may be, for example, screws, rivets, bolts, or other fasteners known in the art. Coupling end portions 106 of flat spring member 102 to end portions 108 of coil spring member 104 using fasteners 110 may secure the end portions together to inhibit the end portions from being separated during use.

In certain embodiments, coil spring member 104 is substantially covered with a paint or sealant. Covering coil spring member 104 with paint or sealant inhibits dust or other particles from getting between the coils in the coil spring member. In certain embodiments, cover 112 is placed over coil spring member 104. Cover 112 may be, for example, a rubber or elastomeric cover. In certain embodiments, cover 112 is relatively thin and bends with little or no resistance. In some embodiments, cover 112 is a user graspable cover. Cover 112 may be coupled to coil spring member 104 and/or flat spring member 102 using an adhesive or the cover may be molded to or around the coil spring member. In some embodiments, cover 112 substantially covers end portions 106 of flat spring member 102 and fasteners 110.

In certain embodiments, a thin piece of sandpaper or another abrasive material is coupled to the bottom side of flat spring member 102 (e.g., the side opposite coil spring member 104). The sandpaper or abrasive material may be coupled to flat spring member 102 using an adhesive or other methods known in the art for coupling sandpaper to steel surfaces. The sandpaper may be used to sand the surface of the automobile or another surface while flat spring member 102 provides a supportive surface for the sandpaper. Coupling the sandpaper or abrasive material to flat spring member 102 inhibits buckling or bunching of the sandpaper when sander 100 (and the flat spring member) is flexed or curved for use on a curved surface. Buckling is inhibited because the surface of flat spring member 102 coupled to the sandpaper does not change in length during use (e.g., during flexing or bending of sander 100). Having the sandpaper coupled to flat spring member 102 also allows the sandpaper to be repeatedly flexed and straightened without tearing or buckling the sandpaper.

Figure 3:
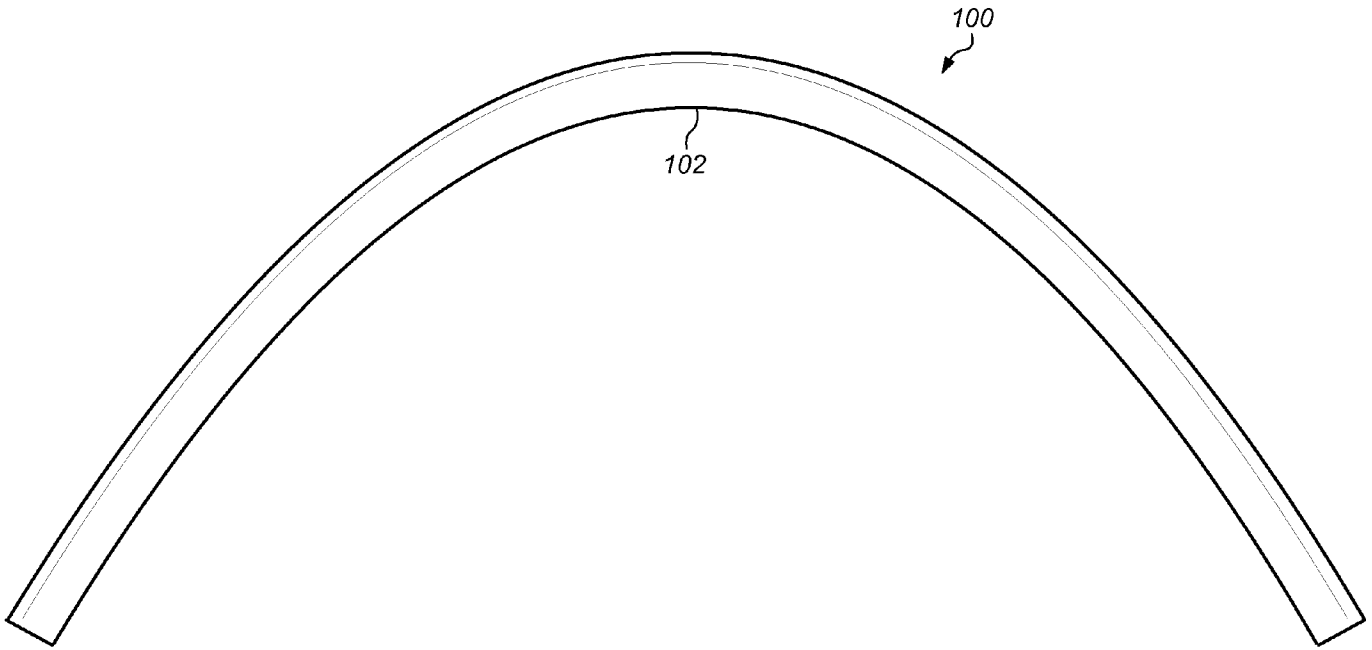
FIG. 3 depicts a side-view representation of a sander in a flexed position with the ends of the sander being bent in the direction shown by the arrows in FIG. 2.

Flat spring member 102 and coil spring member 104 may be coupled together such that the members flex or bend together simultaneously. The presence of coil spring member 104 coupled to flat spring member 102 allows sander 100 to be easily flexed or curved or arced to accommodate the profile of the surface being worked on (e.g., the surface being sanded). FIG. 3 depicts a side-view representation of sander 100 in a flexed position with the ends of the sander being bent in the direction shown by the arrows in FIG. 2. Being able to easily flex and bend sander 100 allows the user to have a light touch while sanding or spreading using the sander. The light touch allows the user to have a feel for the surface being worked on and thus, for better touch in working on the surface.

Figure 4:
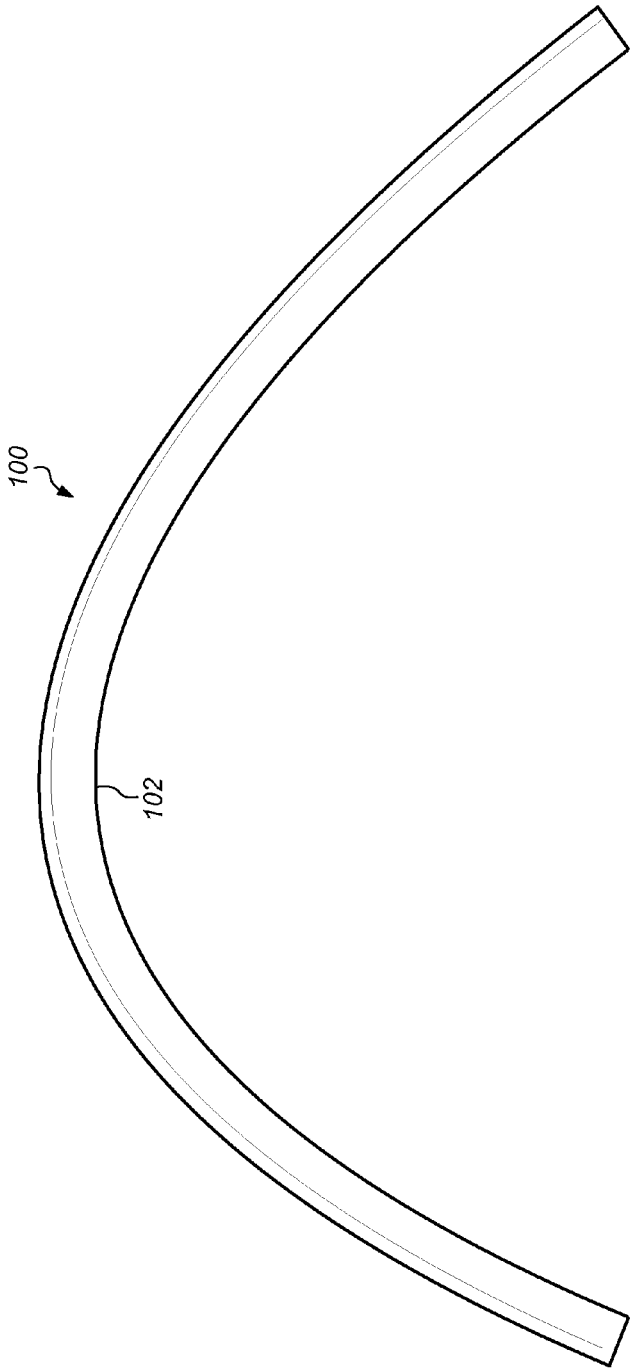
FIG. 4 depicts a side-view representation of a sander in a non-symmetrical flexed position with the ends of the sander being bent in the direction shown by the arrows in FIG. 2.

Sander 100 is shown flexed with a symmetrical curved profile in FIG. 3. It is to be understood, however, that the combination of flat spring member 102 and coil spring member 104 allows sander to be flexed with various different curved profiles, including non-symmetrical profiles, while maintaining a relatively smooth, curved surface on the bottom side of the flat spring member (e.g., the side with sandpaper attached). FIG. 4 depicts a side-view representation of a sander in a non-symmetrical flexed position with the ends of the sander being bent in the direction shown by the arrows in FIG. 2. Thus, sander 100 may be easily and comfortably used by a user on a variety of surfaces with different curved and/or flat profiles (e.g., the sander may be used on various parts or panels of an automobile or other vehicle).

The combination of flat spring member 102 and coil spring member 104 may allow sander 100 to be flexed (e.g., curved or arced) with minimal force by the user. For example, sander 100 may be flexed into an arc with a radius of about 15" using only about 3 to 4 pounds of force on the ends of the sander. Typical sanders (such as the sander described in U.S. Pat. No. 6,554,113 to Wheeler) may require much more force (on the order of 20 pounds of force with the rods removed) to achieve a similar radius arc of about 15", which is typically the minimum arc radius recommended for such sanders. In certain embodiments, sander 100 has a minimum arc radius that is about 3", which provides more curvature than typical sanders. In some embodiments, sander 100 may have a minimum arc radius that less than about 3". In addition, as described above, typical sanders may not provide a desired arc because of the thickness and stiffness of the flexible sanding apparatus. Sander 100 may, however, provide a desired arc with a smoothly curved profile because of the interaction of flat spring member 102 and coil spring member 104.

In some embodiments, flat spring member 102 and coil spring member 104 are coupled to allow sander 100 to be flexed in a twisting motion. Twisting sander 100 may be useful when working on (e.g., sanding) angled surfaces such as fenders of an automobile. The twisting motion of sander 100 allows the user to track the surfaces of the angled surface more closely by moving the sander at complementary angles.

Figure 5:
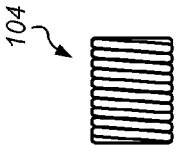
FIG. 5 depicts a side-view representation of an embodiment of a closed coil spring member.

In certain embodiments, sander 100 flexes into a concave shape, as shown in FIG. 3 (e.g., the sanding surface on the bottom of flat spring member 102 has a concave curved shape). Flexing sander 100 into the concave shape allows for sanding (or spreading of material) on a convex shaped surface. In certain embodiments, coil spring member 104 is an elongated coil spring with minimal spacing between the coils (e.g., the coil spring member is a closed coil spring member with little or no spacing between the coils). FIG. 5 depicts a side-view representation of an embodiment of a closed coil spring member 104. Flat spring member 102 and coil spring member 104, when connected as shown in FIG. 2, may flex easily when opening up the coils in the coil spring member away from the flat spring member but the coils are locked in a straight position when trying to open the coils attached to the flat spring member. Thus, having little or no spacing between the coils in coil spring member 104 allows concave flexing of sander 100 while inhibiting substantially any convex flexing of the sander (e.g., flexing of the sander in the opposite direction of the arrows shown in FIG. 2).

Inhibiting convex flexing of sander 100 allows the sander to have a relatively flat profile sanding surface when desired (e.g., the sander is relatively flat or straight when the user tries to flex the sander convexly). With little or no spacing between the coils in coil spring member 104, the sanding surface may be straightened into the relatively flat profile by pushing the ends of sander 100 in a direction opposite the direction of the arrows shown in FIG. 2. Forming the relatively flat profile with sander 100 provides a flat surface for making flat surfaces and/or for sanding (or spreading of material) on flat surfaces.

Figure 6:
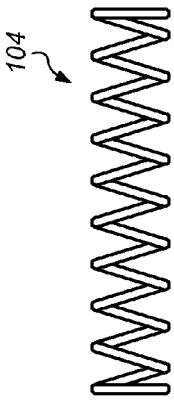
FIG. 6 depicts a side-view representation of an embodiment of an open coil spring member.

In some embodiments, coil spring member 104 is an open coil spring member (e.g., there is some spacing between coils on the coil spring member). FIG. 6 depicts a side-view representation of an embodiment of an open coil spring member 104. Having space between the coils on coil spring member 104 may allow convex flexing of sander 100. The amount of convex flexing of sander 100 allowed may be controlled by providing a desired spacing between coils on coil spring member 104. For example, providing larger spacing between the coils will allow more convex flexing while reducing the spacing will allow less convex flexing. Using an open coil spring member may be more useful for smaller type sanders (e.g., sanders used on small objects or in tight spaces) where increased flexibility is needed.

Figure 7:
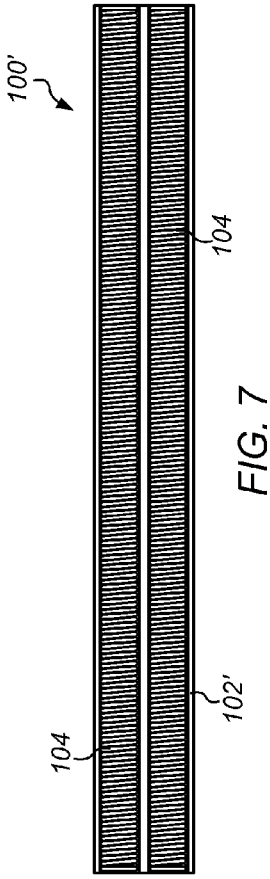
FIG. 7 depicts a top-view representation of a sander with two coil spring members on a flat spring member.

In some embodiments, a sander includes two or more coil spring members coupled to a single flat spring member. FIG. 7 depicts a top-view representation of sander 100' with two coil spring members 104 on flat spring member 102'. Flat spring member 102' may have a width to accommodate two (or more) coil spring members 104 being coupled to one flat surface of the flat spring member. Using two or more coil spring members 104 in sander 100' may provide a sander with increased sanding surface width (e.g., the width of flat spring member 102' is increased) while maintaining many of the advantages of having the coil spring member coupled to the flat spring member.

Figure 8:
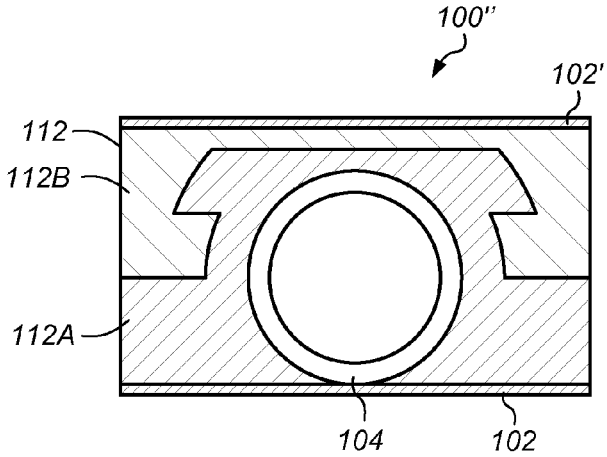
FIG. 8 depicts a cross-sectional end-view representation of an embodiment of a sander with a second sanding surface.

In some embodiments, a sander includes a second sanding surface. In embodiments with the coil spring member being a closed spring member, the second sanding surface may be used to sand concave shaped surfaces by providing a convex sanding surface. FIG. 8 depicts a cross-sectional end-view representation of an embodiment of sander 100" with a second sanding surface. Similar to sander 100 depicted in FIGS. 1-4, sander 100" includes flat spring member 102, coil spring member 104, and cover 112.

In certain embodiments, as shown in FIG. 8, cover 112 includes first cover portion 112A and second cover portion 112B. First cover portion 112A and second cover portion 112B may include similar materials such as elastomeric or rubber materials used for cover 112. Flat spring member 102 may be coupled to first cover portion 112A and coil spring member 104 may be located inside first cover portion 112A. First cover portion 112A may be coupled to second cover portion 112B using, for example, a sliding engagement such as the sliding engagement shown in FIG. 8. Such an engagement allows first cover portion 112A and second cover portion 112B to move (slide) relative to each other during use of sander 100" and accommodate changes in length between the cover portions when flexing the sander. First cover portion 112A and second cover portion 112B may be easily coupled and uncoupled as needed by the user by sliding the cover portions relative to each other to couple or uncouple the cover portions. In some embodiments, a pin or other detent is used to hold second cover portion 112B in place on first cover portion 112A. It is to be understood that other types of engagements between first cover portion 112A and second cover portion 112B may also be used (e.g., engagements using fasteners or snap fit engagements).

In certain embodiments, second flat spring member 102' is coupled to second cover portion 112B, as shown in FIG. 8. Second flat spring member 102' may be positioned on sander 100" substantially opposite flat spring member 102 (e.g., the first flat spring member). Thus, sander 100" has two sanding surfaces substantially opposite each other. Sander 100" may be flexed in a similar manner to the flex shown in FIGS. 3 and 4, and the sander may then be used to sand either convex shaped or flat surfaces using the first flat spring member or concave shaped surfaces using the second flat spring member.

Figure 9:
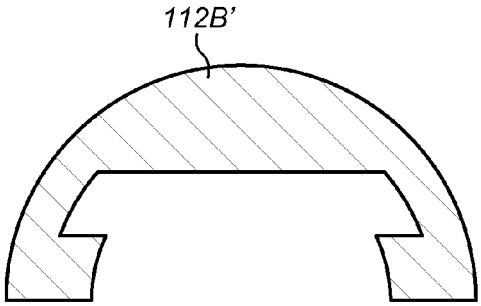
FIG. 9 depicts a cross-sectional end-view representation of an embodiment of a second cover portion that may be used as a user graspable cover portion.

In some embodiments, second cover portion 112B, with second flat spring member 102' coupled to the second cover portion, is removed and replaced with another second cover portion that is used as a handle (e.g., a user graspable cover portion). FIG. 9 depicts a cross-sectional end-view representation of an embodiment of a second cover portion that may be used as a user graspable cover portion. Second cover portion 112B' may have the same sliding engagement configuration as second cover portion 112B to engage first cover portion 112A. Thus, second cover portion 112B (shown in FIG. 8) and second cover portion 112B' (shown in FIG. 9) are interchangeably coupled to first cover portion 112A to allow the user to have either a second sanding surface or a user graspable handle coupled to sander 100".

Figure 10:
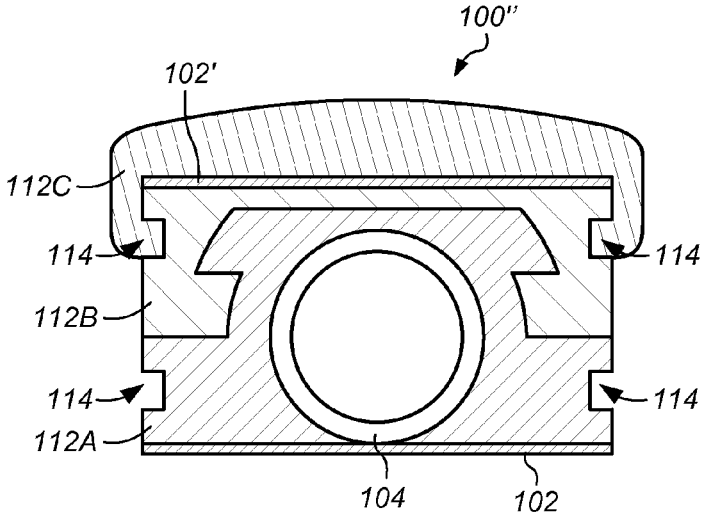
FIG. 10 depicts a cross-sectional end-view representation of an embodiment of a sander with a third cover portion placed over a second sanding surface.

In certain embodiments, first cover portion 112A and second cover portion 112B, shown in FIG. 8, include notches for coupling a third cover portion over either the first or second cover portions. FIG. 10 depicts a cross-sectional end-view representation of an embodiment of sander 100" with third cover portion 112C placed over the second sanding surface. First cover portion 112A and second cover portion 112B may include notches 114. Notches 114 allow third cover portion 112C to be coupled to either first cover portion 112A or second cover portion 112B (third cover portion 112C is shown coupled to second cover portion 112B in FIG. 10). Third cover portion 112C may be, for example, an elastomeric or rubber cover portion that is graspable by a user. Thus, coupling third cover portion 112C to either first cover portion 112A or second cover portion 112B allows the user to more easily and more comfortably use sander 100" on flat, convex, or concave shaped sanding surfaces by moving the third cover portion to the appropriate side of the sander and covering the unused sanding surface.

In certain embodiments, sanders described herein (e.g., sander 100, sander 100', and/or sander 100") are used in a process for repairing body panels on an automobile (or other similar surfaces). As an example, when repairing body panels, the normal procedure has been to bump the panels back into shape as much as possible using body hammers and dollies before adding filler or primer to the surface of the body panels. Because of the flexibility of sander 100 (as well as sander 100' or sander 100"), the sander may be used as a guide to assess high and low spots on the surface by tilting up the closer edge of the sander enough to see the back edge of the sander. The back edge may be flexed to the proper contour to make contact with the surface and then be pulled across the surface. Low spots may show up as gaps between the edge of the sander and the surface while high spots may lift the sander edge on both sides. The low and high spots may be worked some more with the hammer and dolly until the overall contour looks approximately correct.

The low spots may then be filled with filler using the same process (e.g., moving the sander across the surface). Since the low spots have been identified with the edge of the sander, the filler may be applied to the low spots and then accurately smoothed to the proper contour with the sander being used as a spreader. After the filler has hardened, sandpaper may be attached to the sander and used to sand the filled area until it becomes smooth and properly contoured. After sanding, the surface may be primed and then sanded with finer sandpaper before adding the final color and/or clear coats.

On high quality paint work, the clear coat or final color may again be contour sanded with very fine sandpaper to remove any "orange peel" or other imperfections in the paint surface. During this process, it is important to use light pressure to keep the sandpaper from "loading up" and causing scratches. The flexible sander described herein allows the user to sand with such light pressure. After the final sanding, the paint may be polished to a high gloss.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a portion" includes a combination of two or more portions and reference to "a material" includes mixtures of materials.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A sanding apparatus, comprising:

a thin, relatively flat spring member; and one or more coil spring members attached to a first side of the flat spring member along a length of the flat spring member, wherein at least one coil spring member is attached to the first side of the flat spring member such that coils of the coil spring member at contact points between the coil spring member and the flat spring member along the length of the flat spring member do not move in relation to the flat spring member;

wherein a sanding surface is configured to be coupled to a second side of the flat spring member.

2. The apparatus of claim 1, wherein the flat spring member and the coil spring members are elongated members coupled together lengthwise.

3. The apparatus of claim 1, wherein at least one of the coil spring members comprises a closed coil spring member.

4. The apparatus of claim 3, wherein the closed coil spring members allows concave flexing of the sanding surface and inhibits convex flexing of the sanding surface.

5. The apparatus of claim 3, wherein the sanding surface is positionable in a relatively flat profile.

6. The apparatus of claim 1, wherein at least one of the coil spring members comprises an open coil spring member.

7. The apparatus of claim 1, wherein end portions of the flat spring member are turned up substantially perpendicular to the first and second sides of the flat spring member, and wherein fasteners are used to couple the end portions of the flat spring member to a plug material positioned inside end portions of the coil spring member.

8. The apparatus of claim 1, further comprising a cover that at least partially encloses the coil spring member.

9. The apparatus of claim 8, wherein the cover comprises an elastomeric cover.

10. A sanding apparatus, comprising:

a first thin, relatively flat spring member;

one or more coil spring members coupled to a first side of the flat spring member along a length of the flat spring member;

a first cover portion at least partially enclosing the coil spring members on the first flat spring member; and a second thin, relatively flat spring member removably coupled to the first cover portion using a second cover portion;

wherein a first sanding surface is configured to be coupled to a second side of the flat spring member; and wherein a second sanding surface is configured to be coupled to a surface of the second flat spring member opposite the second side of the first flat spring member configured to be coupled to the first sanding surface.

11. The apparatus of claim 10, wherein the first flat spring member and the coil spring members are elongated members coupled together lengthwise.

12. The apparatus of claim 10, wherein the first sanding surface is configured to be used for sanding flat or convex surfaces, and the second sanding surface is configured to be used for sanding concave surfaces.

13. The apparatus of claim 10, further comprising a third cover portion coupled to either the first cover portion or the second cover portion, wherein the third cover portion at least partially covers the sanding surface of cover portion to which the third cover portion is coupled.

14. The apparatus of claim 10, wherein at least one of the coil spring members comprises a closed coil spring member.

15. The apparatus of claim 14, wherein the coil spring members inhibit convex flexing of the first sanding surface.

16. The apparatus of claim 10, further comprising a second cover portion removably coupled to the first cover portion, wherein the second cover portion comprises a user graspable cover portion.

17. A sanding apparatus, comprising:

a thin, relatively flat spring member;

one or more coil spring members coupled to a first side of the flat spring member along a length of the flat spring member, wherein at least one of the coil spring members comprises a closed coil spring member that inhibits convex flexing of the sanding surface; and wherein a sanding surface is configured to be coupled to a second side of the flat spring member.

18. The apparatus of claim 1, wherein the flat spring member and the coil spring members are elongated members coupled together lengthwise.

19. The apparatus of claim 1, wherein the coils of the coil spring member at the contact points between the coil spring member and the flat spring member are locked together in a straight position and cannot open when the sanding surface is substantially flat.

20. The apparatus of claim 17, wherein the coil spring member inhibits convex flexing of the sanding surface because coils of the coil spring member at contact points between the coil spring member and the flat spring member along the length of the flat spring member do not move in relation to the flat spring member.

21. The apparatus of claim 17, wherein the coil spring member inhibits convex flexing of the sanding surface because coils of the coil spring member at contact points between the coil spring member and the flat spring member along the length of the flat spring member are locked together in a straight position and cannot open when the sanding surface is substantially flat.

22. A sanding apparatus, comprising:

a thin, relatively flat spring member; and one or more coil spring members attached to a first side of the flat spring member along a length of the flat spring member, wherein at least one coil spring member is attached to the first side of the flat spring member such that a line or lines of contact is formed between the spring members in which the spring members do not move in relation to each other when the spring members are flexed;

wherein a sanding surface is configured to be coupled to a second side of the flat spring member.

23. A sanding apparatus, comprising:

a thin, relatively flat spring member; and one or more coil spring members attached to a first side of the flat spring member along a length of the flat spring member;

wherein end portions of the flat spring member are turned up substantially perpendicular to the first and second sides of the flat spring member, and wherein the end portions of the flat spring member are coupled to end portions of the coil spring member; and wherein a sanding surface is configured to be coupled to a second side of the flat spring member.

24. The apparatus of claim 23, wherein fasteners are used to couple the end portions of the flat spring member to a plug material inside the end portions of the coil spring member.

25. The apparatus of claim 23, wherein the end portions of the flat spring member comprise positive end connections coupled to the end portions of the coil spring member, and wherein the positive end connections reinforce and prevent the coil spring member from expanding along the connection points when the sanding surface is being pushed toward a convex position.

* * * * *